US006435161B1

(12) United States Patent
Kato

(10) Patent No.: US 6,435,161 B1
(45) Date of Patent: Aug. 20, 2002

(54) FUEL INJECTION SYSTEM FOR OUTBOARD MOTOR

(75) Inventor: Masahiko Kato, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/648,934

(22) Filed: Aug. 24, 2000

(30) Foreign Application Priority Data

Aug. 24, 1999 (JP) ..... 11-236459

(51) Int. Cl.[7] ..... F02M 37/04
(52) U.S. Cl. ..... 123/468; 123/469; 123/510
(58) Field of Search ..... 123/468, 469, 123/516, 510

(56) References Cited

U.S. PATENT DOCUMENTS 4,916,947 A 4/1990 Suzuki
5,375,578 A * 12/1994 Kato et al. ..... 123/516
5,533,478 A * 7/1996 Robinson ..... 123/510
5,669,358 A 9/1997 Osakabe
5,988,705 A * 11/1999 Norkey ..... 285/319

* cited by examiner

*Primary Examiner*—Thomas N. Moulis
(74) *Attorney, Agent, or Firm*—Knobbe, Martens, Olson & Bear, LLP

(57) ABSTRACT

An engine of an outboard motor includes a fuel injection system. In a preferred mode, the fuel injection system comprises a high pressure fuel system and a vapor separator assembly. The high pressure fuel system includes a fuel injector that is removably attached to the engine. The vapor separator assembly includes a vapor separator and is also removably attached to the engine. The high pressure fuel system and said vapor separator assembly are connected by a quick connector. Preferably, one end of the quick connector is formed from an outlet end of a fuel filter.

16 Claims, 6 Drawing Sheets

FUEL INJECTION SYSTEM FOR OUTBOARD MOTOR

PRIORITY INFORMATION

The present application is based on and claims priority to Japanese Patent Application No. 11-236459, filed Aug. 24, 1999, the entire contents of which is hereby expressly incorporated by reference.

BACKGROUND OF THE INVENTION

1. Field of the Invention

This invention relates to a fuel supply system for a fuel injected engine. More particularly, the present invention relates to a modular assembly arrangement of the fuel supply system.

2. Related Art

In all fields of engine design, there is a demand for obtaining more effective emission control and better fuel economy while at the same time increasing power output. To meet this demand, indirect fuel injection systems have replaced carburetors as the engine charge former. In such systems, fuel is typically injected into an intake air manifold. In order to achieve even better performance, direct fuel injection systems have been developed. These systems inject fuel directly into the combustion chamber through a fuel injector. The principle advantage of direct fuel injection systems is that mixing of the fuel and the air within the combustion chamber can be precisely controlled.

Both indirect and direct fuel injection systems typically include many components. To decrease the cost of assembly and repair, many of these components have been combined into sub-units, which together form the fuel supply system. However, there is a general difficulty associated with the connections between sub-systems.

For example, to reduce or prevent fuel leaks, the connections between the sub-units should be adequately sealed. Typically, this is done by applying caulking or a similar compound to the connection. However, this process typically is very time consuming and physically difficult. In addition, during maintenance, the connection often needs to be broken. However, breaking the connection typically requires removing the caulking or similar compound, which is also very time consuming and physically difficult.

Moreover, in outboard motors the engine is surrounded by a protective cowling. In such an environment, there is limited workspace between the engine and the cowling. Applying the caulking or similar compound in such an environment is particularly difficult and time consuming. Further due to the compact arrangement of components in marine engines, manipulating the components and manipulating tools to install and connect the components is very difficult.

SUMMARY OF THE INVENTION

There is therefore a need for an improved method for connecting the sub-units of a fuel supply system together. The improved method should provide a quick, secure and leak proof connection between the sub-units. Moreover, the improved method should be suitable for environments with limited workspace.

In accordance with one aspect of the invention a fuel injected system for an internal combustion engine includes a high pressure fuel system and a vapor separator assembly. The high pressure fuel system includes a fuel injector and is removably attached to the engine. The vapor separator assembly includes a vapor separator and also is removably attached to the engine. The high pressure fuel system and the vapor separator assembly are connected by a quick connector.

In accordance with another aspect of the invention, a method for assembling a fuel injection system for an internal combustion engine includes the following. Attaching a high pressure fuel system that includes a fuel injector to the engine. Attaching a vapor separator assembly that includes a vapor separator to the engine. Forming a substantially leak proof connection between the high pressure fuel system and the vapor separator assembly by combining two ends of a quick connector.

In accordance with yet another aspect of the invention, a method for disassembling a fuel injection system for an internal combustion engine includes the following. Disconnecting a substantially leak proof connection between a high pressure fuel system that includes a fuel injector and a vapor separator assembly that includes a vapor separator by separating two ends of a quick connector. Detaching the high pressure from the engine. Detaching the vapor separator assembly from the engine.

In accordance with still yet another aspect of the invention, a fuel injected system for an internal combustion engine includes a high pressure fuel system and a vapor separator assembly. The high pressure fuel system includes a fuel injector and a high pressure fuel pump for supplying high pressure fuel to the fuel injector. The high pressure fuel system is removably attached to the engine. The vapor separator assembly includes a vapor separator and a low pressure fuel pump that includes a discharge end connected to a fuel filter. The vapor separator assembly also is removably attached to the engine. The high pressure fuel system and the vapor separator assembly are connected by a quick connector. An outlet of the fuel filter forms part of the quick connector.

In accordance with another aspect of the invention, an outboard motor includes an engine disposed within a protective cowling. The engine includes a fuel supply system. The fuel supply system includes a first component, a second component and a fuel filter. The first component communicates with a first supply line. A first connection ties between the first component and the first supply line and is substantially leak-proof The second component communicates with a second fuel supply line. A second connection lies between the second component and the second fuel supply line and is substantially leak-proof. The first supply line and the second fuel supply line are connected together by a quick-connect coupling. The quick connect coupling is positioned proximate to the fuel filter.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described with reference to the drawings of several preferred embodiments, which embodiments are intended to illustrate and not to limit the present invention, and in which drawings.

DETAILED DESCRIPTION OF THE PREFERRED EMBODIMENTS OF THE INVENTION

Figure 1:
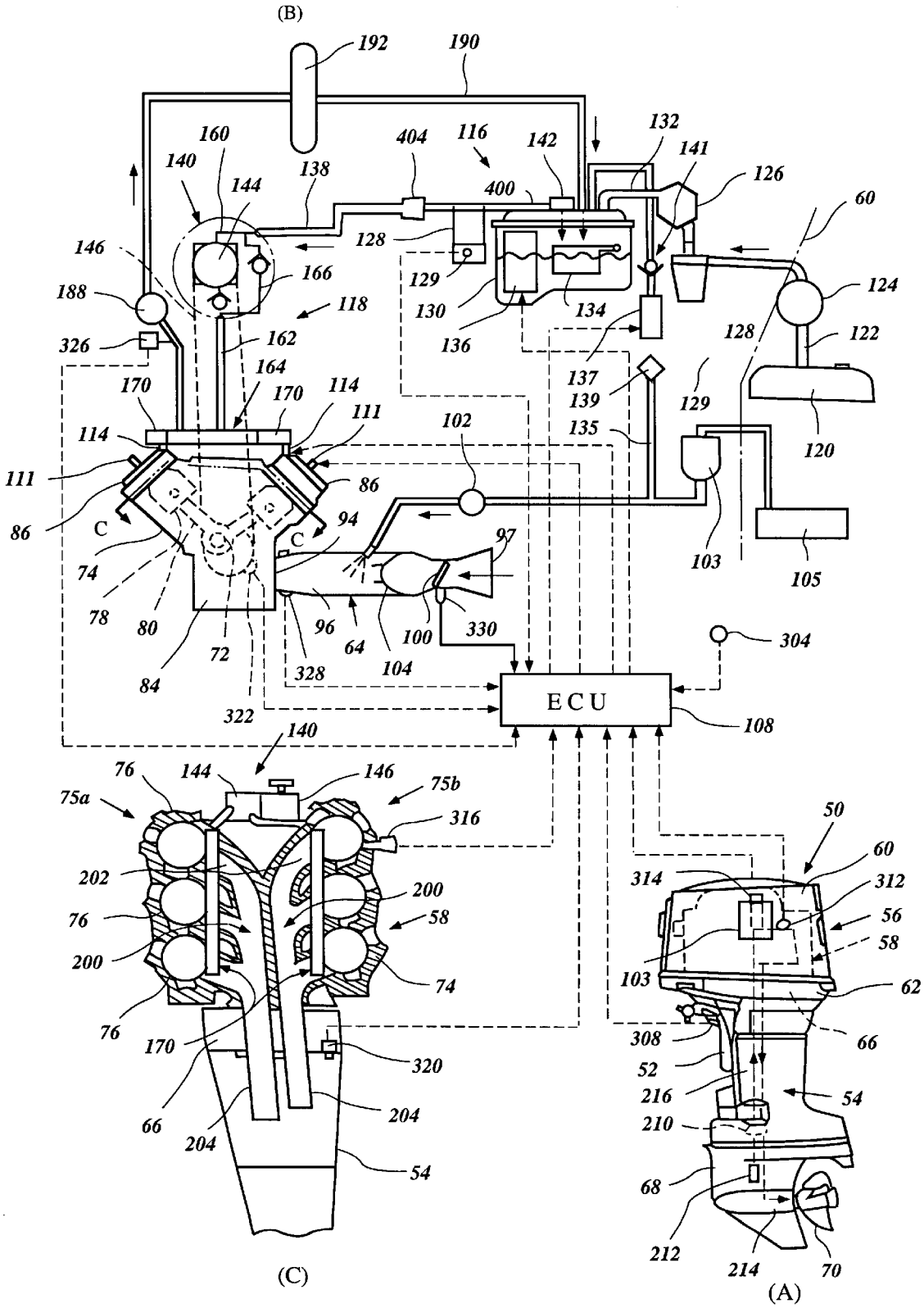
FIG. 1 is a multi-part view showing: (A) in the lower right hand portion, a side elevation view of an outboard motor employing certain features, aspects and advantages of the present invention; (B) in the upper portion, a partially schematic view of the engine of the outboard motor with its induction and fuel injection system shown in part schematically; and (C) in the lower left hand portion, a rear elevation view of the outboard motor with portions removed and other portions broken away and shown in section along the line C—C in the upper view B so as to more clearly show the construction of the engine. An ECU (electric control unit) for the motor links the three views together.

With reference now to FIG. 1, an outboard motor with a fuel supply system having certain features, aspects and advantages of the present invention will be described. While the present invention will be described in the context of the outboard motor, it is anticipated that the present fuel supply system can have utility in other environments of use. For instance, the fuel supply system can be used in any vehicular application featuring a fuel supply system, such as automotive and marine applications. Moreover, the present fuel supply system can also be used in stationary engines, such as those found on generators, for instance.

In the lower right hand view of FIG. 1 (i.e., FIG. 1(A)), the outboard motor is depicted in side elevation view and is identified generally by the reference numeral 50. The outboard motor 50 preferably includes a clamping arrangement 52. The clamping arrangement 52 is used to attach the outboard motor 50 to the hull of the watercraft (not shown) in any suitable manner. The outboard motor 50 preferably is connected to the hull of the watercraft such that it may be steered about a generally vertical axis and tilted or trimmed about a generally horizontal axis.

The outboard motor 50 generally comprises a drive shaft housing 54 and a powerhead 56, which is positioned generally above, and generally is supported by, the drive shaft housing 54. The powerhead 56 preferably includes a powering internal combustion engine, which is indicated generally by the reference numeral 58. The engine 58 also is shown in the remaining two views of FIG. 1 (i.e., FIGS. 1(B) and 1(C)) and, therefore, will be described in more detail below with reference to these portions of FIG. 1.

The illustrated powerhead 56 generally includes a protective cowling which comprises a main cowling portion 60 and a lower tray portion 62. The main cowling portion 60 preferably includes a suitable air inlet arrangement (not shown) to introduce atmospheric air into the interior of the protective cowling. The air present within the protective cowling then can be drafted into an engine intake system or induction system, which is generally indicated by the reference numeral 64 (see FIG. 1(B)) and which will be described in greater detail directly below.

The main cowling portion 60 preferably is detachably connected to the lower tray portion 62 of the powerhead 56. The detachable connection preferably is generally positioned proximate an exhaust guide plate 66. The exhaust guide plate 66 is encircled by an upper portion of the drive shaft housing 54 and forms a portion of an exhaust system, which will be described below. Positioned beneath the illustrated drive shaft housing 54 is a lower unit 68 in which a propeller 70 is journaled for rotation. As these constructions are well known to those of ordinary skill in the art, further description of these components is unnecessary.

As is typical with outboard motor practice, the illustrated engine 58 is supported in the powerhead 56 so that a crankshaft 72 (see FIG. 1(B)) can rotate about a generally vertically extending axis. FIG. 1(B) schematically illustrates the engine from a top view. The vertical mounting of the crankshaft 72 facilitates the connection of the crankshaft 72 to a driveshaft (not shown) that depends into and through the driveshaft housing 54. The driveshaft drives the propeller 70 through a forward, neutral and reverse transmission (not shown) contained in the lower unit 68. Of course, other suitable types of transmissions also can be used with certain features, aspects and advantages of the present invention.

With reference now to FIG. 1(C), the illustrated engine 58 is of the V6 type and operates on a 2-stroke crankcase compression principle. It is anticipated that the present fuel supply system also can be utilized with engines having other cylinder numbers and other cylinder configurations. For instance, the cylinders can be arranged in-line in some arrangements, and the engine can comprise as few as one or more than eight cylinders in various other arrangements. Moreover, certain features of the present fuel injector mounting arrangement also may find utility with engines operating on other operating principles, such as a rotary principle or a four-cycle principle.

With reference now to FIGS. 1(B) and 1(C), the illustrated engine 58 is generally comprised of a cylinder block 74 that is formed with a pair of cylinder banks 75*a,b*. Each of these cylinder banks 75*a, b* preferably is formed with three vertically-spaced horizontally-extending cylinder bores 76 (see FIG. 1(C)). In some arrangements, separate cylinder bodies for each cylinder bore can be used in place of the single cylinder block. For instance, each cylinder body may accommodate but a single cylinder bore and a number of cylinder bodies can be aligned side by side yet be formed separate from one another.

A set of corresponding pistons 78 preferably are arranged and configured to reciprocate within the cylinder bores 76. The illustrated pistons 78 are connected to the small ends of connecting rods 80. The big ends of the connecting rods 80 preferably are journaled about the throws of the crankshaft 72 in a well known manner.

With continued reference to FIG. 1(B), the illustrated crankshaft 72 is journaled in any suitable manner for rotation within a crankcase chamber (not shown). Desirably, the crankcase chamber (not shown) is formed, at least in part, by a crankcase member 84 that may be connected to the cylinder block 74 or the cylinder bodies in any suitable manner. As is typical with 2-stroke engines, the illustrated crankshaft 72 and the crankcase chamber (not shown) preferably are formed with dividing seals or dividing walls such that each section of the crankcase chamber (not shown) associated with one of the cylinder bores 76 can be sealed from the other sections that are associated with other cylinder bores. This type of construction is well known to those of ordinary skill in the art.

With reference to FIG. 1(B), a cylinder head assembly, indicated generally by the reference numeral 86, preferably is connected to an end of each of the cylinder banks that is spaced from the crankcase member 84. Each cylinder head assembly 86 generally is comprised of a main cylinder head member and a cylinder head cover member, which are not shown. The cylinder head cover member is attached to the cylinder head member in any suitable manner. As is known, the cylinder head member preferably includes a recess that corresponds with each of the cylinder bores 76. As will be appreciated, each of the recesses cooperates with a respective cylinder bore 76 and a head of a reciprocating piston 78 to define a variable volume combustion chamber.

With reference again to FIG. 1(B), the air induction system 64 is provided for delivering an air charge to the sections of the crankcase chamber (not shown) associated with each of the cylinder bores 76. In the illustrated arrangement, communication between the sections of the crankcase chamber and the air contained within the cowling occurs at least in part via an intake port 94 formed in the crankcase member 84. The intake port 94 can register with a crankcase chamber section corresponding to each of the cylinder bores 76 such that air can be supplied independently to each of the crankcase chamber sections. Of course, other arrangements are also possible.

The induction system 64 also includes an air silencing and inlet device, which is shown schematically in FIG. 1(B), indicated generally by the reference numeral 96. In one arrangement, the device 96 is contained within the cowling member 60 at the cowling's forward end and has a rearwardly-facing air inlet opening (not shown) through which air is introduced into the silencer 96. Air can be drawn into the silencer 96 from within the cowling 60 via an inlet opening 97.

The air inlet device 96 supplies the induced air to a plurality of throttle bodies, or induction devices, 100. Each of the throttle bodies 100 preferably has a throttle valve provided therein. The illustrated throttle valves are desirably supported on throttle valve shafts that are linked to each other for simultaneous opening and closing of the throttle valves in a manner that is well known to those of ordinary skill in the art. It is anticipated, however, that a single supply passage can extend to more than one or even all of the chambers such that the number of throttle valves can be one or more than one depending upon the application.

A lubricant pump 102 preferably is provided for spraying lubricant into the air inlet device 96 for lubricating moving components of the engine 58 in manners well known to those of ordinary skill in the art. In addition, a small amount of lubricant also can be introduced into the fuel prior to introduction to a fuel injector system that will be described in a manner that also will be described. Preferably, the lubricant pump 102 is controlled by an ECU 108, which also will be described in more detail later.

The lubricant pump 102 in the illustrated arrangement draws lubricant from a primary lubricant supply tank 103. In addition, in the illustrated arrangement, lubricant is supplied to the primary lubricant supply tank 103 from an auxiliary tank 105. Other arrangements also can be used.

As is typical in 2-cycle engine practice, the illustrated intake ports 94 include reed-type check valves 104. The check valves 104 permit inducted air to flow into the sections of the crankcase chamber when the pistons 78 are moving upwardly in their respective cylinder bores 76. The reed-type check valves 104, however, do not permit back flow of the air. Therefore, as the pistons 78 move downwardly within the respective cylinder bores 76, the air charge will be compressed in the sections of the crankcase chamber. As is known, the air charge is then delivered into the associated combustion chamber through suitable scavenge passages (not shown). This construction is well known to those of ordinary skill in the art.

A spark plug 111 is mounted within the cylinder head 86 through spark plug openings 111*a* and has an electrode disposed within the combustion chamber. The spark plug 111 is fired under the control of the ECU 108 in any suitable manner. For instance, the ECU 108 may use a CDI system to control ignition timing according to any of a number of suitable control routines. The spark plug 111 ignites an air-fuel charge that is formed by mixing the fuel directly with the air inducted into the combustion chamber.

The fuel is preferably provided via respective fuel injectors 114. The fuel injectors 114 preferably are of the solenoid type and preferably are electronically or electrically operated under the control of the ECU 108. The control of the fuel injectors 114 can include the timing of the fuel injector injection cycle, the duration of the injection cycle, and other operating parameters of the fuel injector 114.

With reference again to FIG. 1(B), and FIGS. 2–5, a fuel supply system for supplying to the fuel injectors 114 will now be described. As will be explained, the fuel supply system has certain features and advantages according to the present invention. The fuel supply system features a vapor separator assembly and a high pressure assembly, which are indicated generally by the reference numbers 116 and 118. Preferably, both the vapor separator assembly 116 and the high pressure assembly 118 are located within the protective cowling of the outboard motor. The high pressure assembly 118 includes a high pressure pumping apparatus 140 and a fuel injector supply system, indicated generally at 164.

A main fuel supply tank 120 supplies fuel to the vapor separator assembly 116. The main fuel supply tank is preferably provided in the hull of the watercraft with which the outboard motor 50 is associated. The preferred location of the main fuel supply tank 120 and the main lubricant reservoir 105 exterior to the outboard motor is demonstrated in FIG. 1(B) through the use of phantom lines. Fuel can be drawn from the main tank 120 through a supply conduit 122 using a first low pressure pump 124. In some arrangements, a plurality of secondary low pressure pumps 126 also can be used to draw the fuel from the fuel tank 120. The pumps can be manually operated pumps, diaphragm-type pumps operated by variations in pressure in the sections of the crankcase chamber, or any other suitable type of pump. Preferably, the pumps 124, 126 provide a relatively low pressure draw on the fuel supply.

From the illustrated secondary low pressure pump 126, the fuel is supplied to a low pressure vapor separator 130, which is part of the vapor separator assembly 116. The vapor separator 130 can be mounted on the engine 58 in any suitable location. In addition, in some arrangements, the vapor separator 130 is separate from the engine, but positioned within the cowling portion 60 at an appropriate location. The fuel is supplied to the vapor separator 130 through a supply line 132. At the vapor separator end of the supply line 132, there preferably is provided a valve, which is not shown, that can be operated by a float 134 to maintain a substantially uniform level of fuel in the vapor separator tank 130.

As described above, the fuel supply preferably receives a small amount of lubricant from the lubricant supply system at a location upstream of the fuel injectors 114. In the illustrated arrangement, the vapor separator tank 130 receives a small amount of lubricant from the lubricant system through a supply conduit 135. A premixing pump 137 draws the lubricant through the supply conduit 135 into the vapor separator tank 130. A filter 139 and a check valve 141 preferably are provided along the conduit 135. The filter 139 removes unwanted particulate matter and/or water while the check valve 141 reduces or eliminates back-flow through the supply conduit 135. Notably, the premixing pump 137 preferably is controlled by the ECU 108. This control can be at least partially dependent upon the flow of fuel and the flow of return fuel into the vapor separator tank 130.

A fuel pump 136 can be provided in the vapor separator 130 and can be controlled by ECU 108 in any suitable manner. In the illustrated arrangement, the connection between the ECU 108 and the fuel pump 136 is schematically illustrated. While the schematic illustration shows a hard-wired connection, those of ordinary skill in the art will appreciate that other electrical connections, such as infrared radio waves and the like can be used. This description of the connection between the ECU 108 and the fuel pump 136 also applies to a variety of other components that also are connected to the ECU 108.

Figure 4:
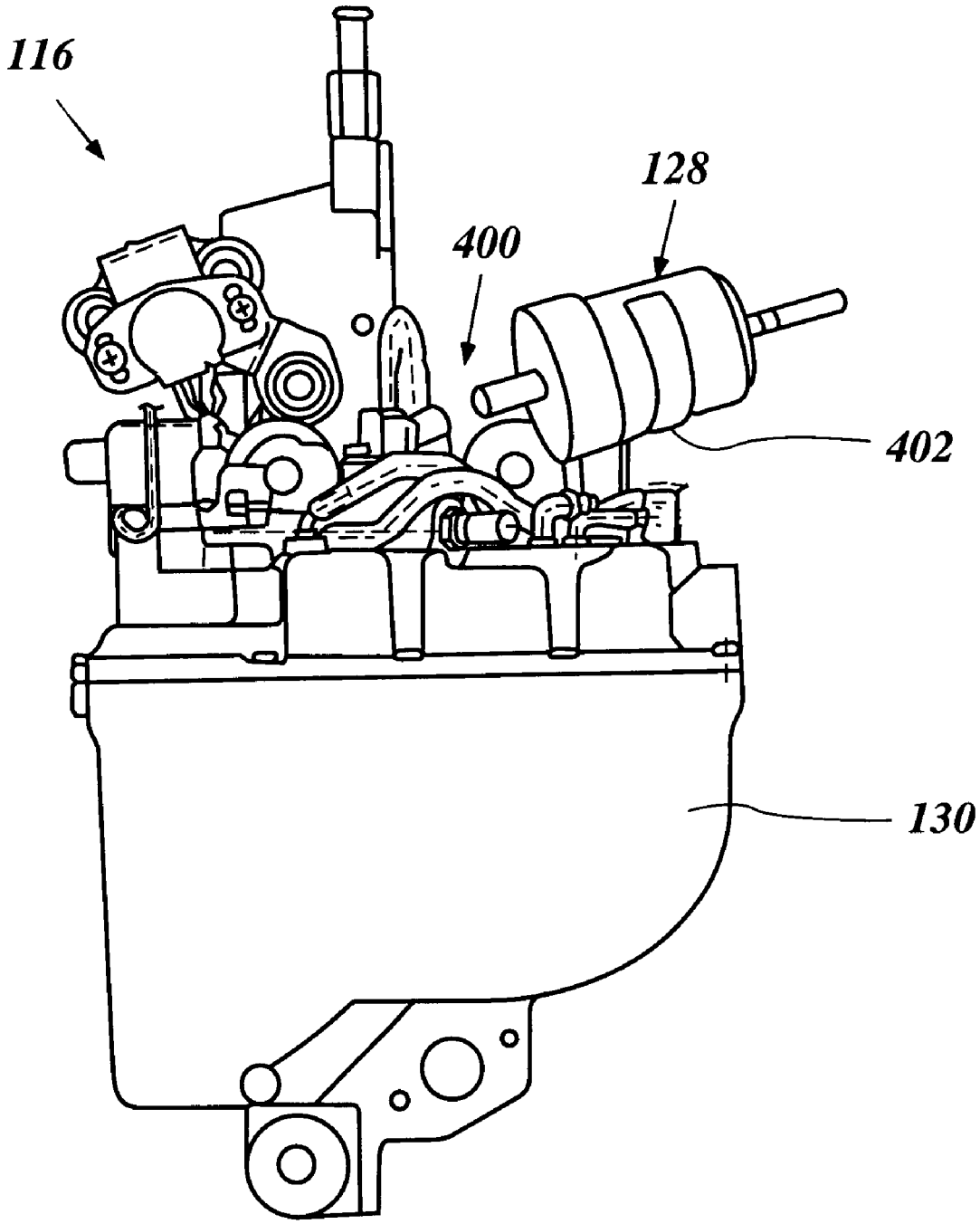
FIG. 4 is side elevational view taken generally in the direction indicated by arrow 4 showing a vapor separator and fuel filter of the motor.

The fuel pump 136 preferably pre-pressurizes the fuel that is delivered through a fuel supply line 138 the high pressure assembly 118 of the fuel supply system. A fuel filter 128 preferably is positioned at the discharge end of the fuel pump 136. Specifically, as shown in FIG. 4, the fuel filter 128 is desirably attached to the top of the vapor separator 130 by a bracket 402. Such a location eases access to the filter for maintenance and inspection. A quick connector 404 (FIG. 1(B)) advantageously connects the outlet of the fuel filter 128 to the fuel supply line 138. The construction of the quick connector will be described i more detail below.

The fuel filter 128 in the illustrated arrangement is used to remove undesirable amounts of water from the fuel. Therefore, the fuel filter 128 includes a sensor 129 that sends a signal to the ECU 108 upon a detection of such water or upon a preset amount of water having been removed from the fuel.

The fuel pump 136, which can be driven by an electric motor in some arrangements, preferably develops a pressure of about 3–10 kg per $cm^2$. A low pressure regulator 142 can be positioned along the line 138 proximate the vapor separator 130 to limit the pressure of the fuel that is delivered to the high pressure pumping apparatus 140 by dumping some portion of the fuel back into the vapor separator 130.

The illustrated high pressure pump apparatus 140 includes a high pressure fuel pump 144 that can develop a pressure of, for example, 50 to 100 $kg/cm^2$ or more. A pump drive unit 146 (see FIGS. 1(C), 2 and 3) preferably is provided for driving the high pressure fuel pump 144. The high pressure fuel pump 144 is mounted on the pump drive unit 146 with bolts 406.

Figure 2:
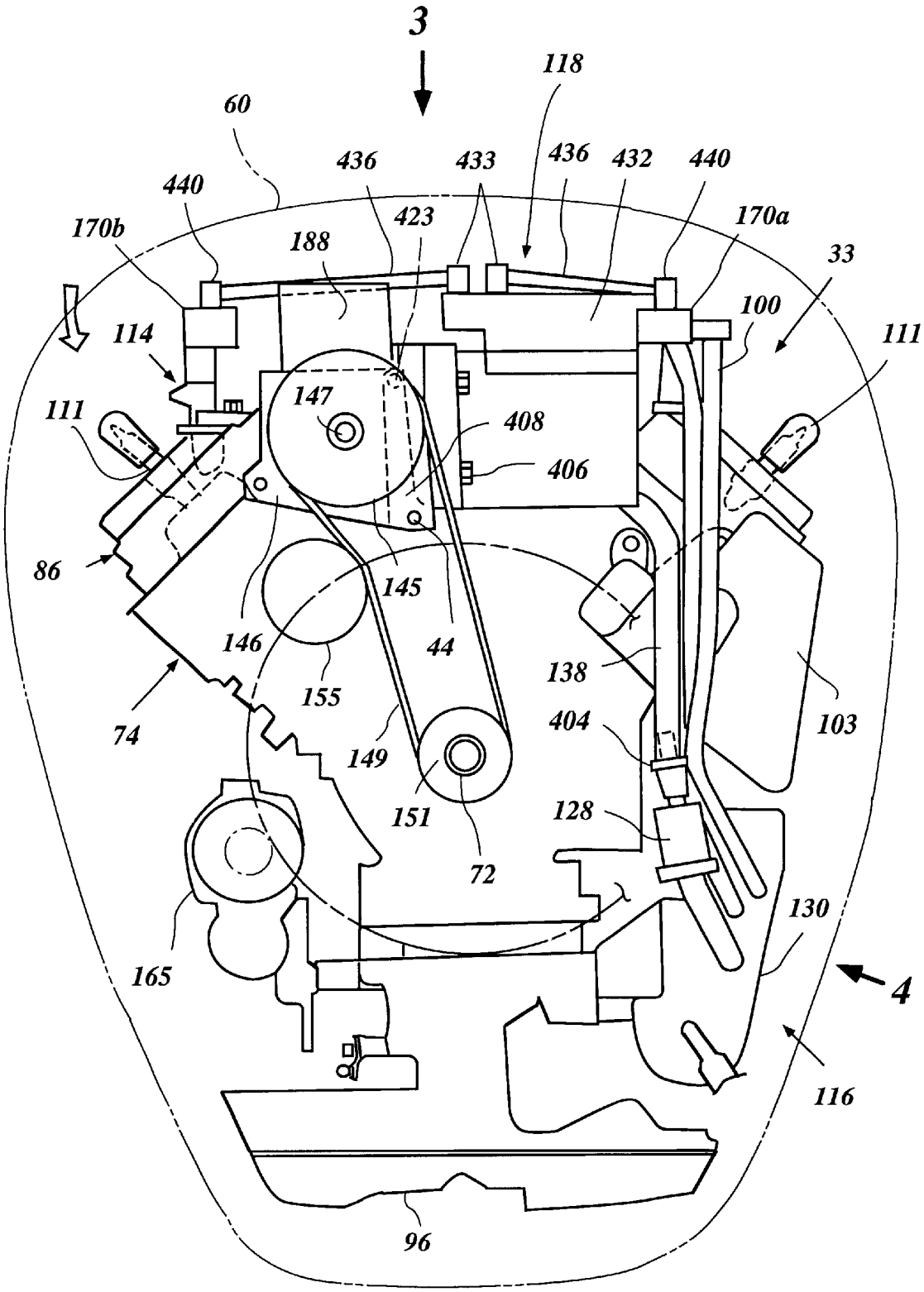
FIG. 2 is a simplified top plan view of the power head of FIG. 1 of a motor showing the engine in solid lines and the protective cowling in phantom.
Figure 3:
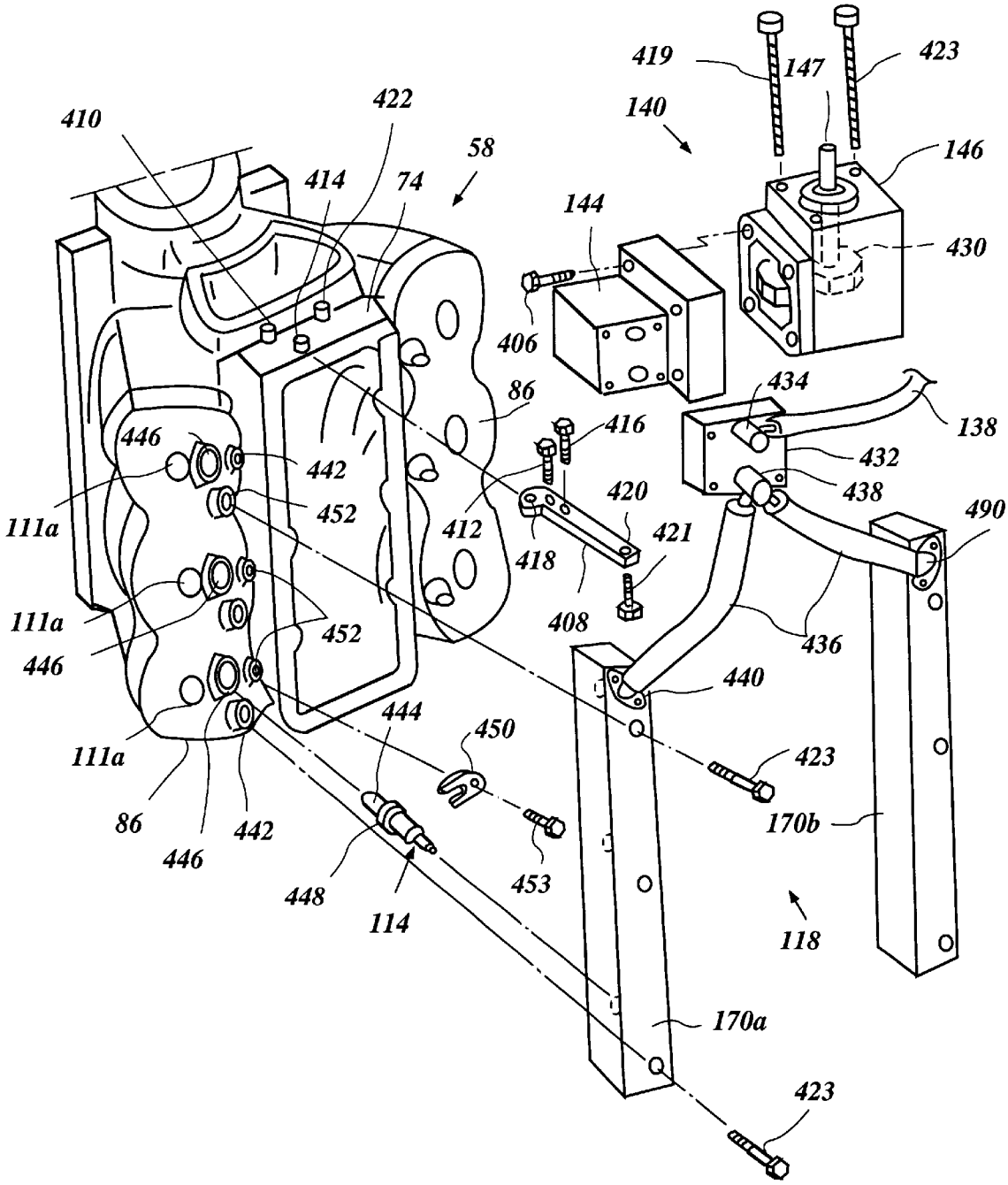
FIG. 3 is an exploded perspective view taken generally in the direction indicated by arrow 3 in FIG. 2 showing components relating to a high pressure fuel injection assembly.

With particular reference to FIGS. 2 and 3, a stay 408 is affixed to the cylinder block 78 at a boss 410 with a bolt 412 and at a boss 414 with a bolt 416. The pump drive unit 146 is affixed to the stay 408 with a bolt 419 that extends through a bolt hole 418 and with bolt 421 that extends through a bolt hole 420. The pump drive unit 146 is affixed to the cylinder block 78 directly at a boss 422 with a bolt 423. Thus, the pump drive unit 146 desirably overhangs between the two cylinder banks 75*a,b* of the V arrangement. A pulley 145 (see FIG. 2) is affixed to a pump drive shaft 147 of the pump drive unit 146. The pulley 145 is driven by a drive pulley 151 affixed to the crankshaft 72 by means of a drive belt 149. The pump drive shaft 147 is provided with a cam disc 430 existing horizontally for pushing plungers (not shown) which are disposed on the high pressure fuel pump 144. A tensioner 155 is preferably provided for maintaining tension on the drive belt 149. Of course, any other suitable driving arrangement can also be used.

The high pressure fuel pump 144 has a unified fuel inlet and outlet module 432, which is mounted on a side wall of the pressure pump 144. The inlet and outlet module 432 has an inlet passage 160 (FIG. 1(B)) connected to the fuel supply line 138 with a connector 434, while an outlet passage 162 (FIG. 1(B)) is connected to a pair of flexible conduits 436 with a couple of connectors 438. The module 432 can also include a bypass passage 166 (FIG. 1(B)) that bypasses the fuel pump 144 and is connected between the low pressure side of the high pressure fuel pump 144 and the outlet high pressure passage 162. Accordingly, fuel can be supplied from the high pressure pump 144 to the fuel injector supply system 164 through the high pressure passage 164 or can be bypassed through the bypass passage 166.

With continued reference to FIGS. 2 and 3, the fuel injector supply system 164 will now be described in detail. A set of flexible conduits 436 are connected to a corresponding set of fuel supply rails 170*a,b* with connectors 440. Preferably, the fuel supply rails 170*a,b* are made of metal so as to be rigid. The fuel supply rails 170*a,b* are generally hollow tubes through which fuel flows. Accordingly, the fuel supply rails 170*a,b*, connect the flexible conduits 436 to the fuel injectors 114, which are connected to the fuel supply rails 170*a,b*. The respective fuel supply rails 170*a,b* are affixed to both of the cylinder heads 86 at bosses 442 with positioning bolts 423. The fuel injectors 114 are held between the fuel supply rails 170*a,b* and the cylinder head members 86. Nozzle portions 444 of the fuel injectors 114 are inserted into bosses 446 so as to be exposed to combustion chambers. Flange portions 448 of the fuel injectors 114 are supported with horse shoe shaped retainers 450 that are affixed to the cylinder head member 86 at bosses 452 with bolts 453. Note that the bosses 442, 446, 452 are merely schematically shown in the other side view of the cylinder head member 86.

The high pressure fuel pump 144, the pump drive unit 146, the inlet and outlet module 432, the flexible conduits 436, the fuel rails 170*a* and the fuel injectors 114 preferably are combined into a single unit. The single unit is the high pressure fuel injection assembly 118.

With reference again to FIG. 1(B), in the illustrated arrangement, pressure of the fuel supplied by the fuel pump 144 to the fuel injectors 114 is regulated to a generally fixed value by a high pressure regulator 188. The illustrated pressure regulator 188 can be mounted on the pump drive unit 146 with bolts (not shown). The pressure regulator 188 preferably is connected to the high pressure supply passage 162. The high pressure regulator 188 preferably dumps fuel back to the vapor separator 130 through a pressure relief line 190 in which a fuel heat exchanger or cooler 192 is provided. Generally, the fuel is desirably kept under constant or substantially constant pressure so that the volume of injected fuel can be at least partially determined by changes of duration of injection under the condition that the pressure for injection is always approximately the same.

As discussed above, the air delivered by the induction system receives the charge of fuel within the combustion chamber and the air/fuel charge is ignited by the ignition system at an appropriate time. After the charge is ignited, the charge bums and expands such that the pistons 78 are driven downwardly in the respective cylinder bores 76 until the pistons 78 reach a lower-most position. During the downward movement of the pistons 78, the exhaust ports (not shown) are uncovered by the piston 78 to allow communication between the combustion chamber 110 and an exhaust system.

With reference to FIG. 1(C), the illustrated exhaust system features an exhaust manifold section 200 for each of the cylinder banks. A plurality of runners 202 extend from the cylinder bore 76 into the manifold collectors 200. The exhaust gases flow through the branch pipes 202 into the manifold collector section 200 of the respective exhaust manifolds that are formed within the cylinder block in the illustrated arrangement. The exhaust manifold collector sections 200 then communicate with exhaust passages formed in exhaust guide plate 66 on which the engine 58 is mounted.

A pair of exhaust pipes 204 depend from the exhaust guide plate 66 and extend the exhaust passages into an expansion chamber (not shown) formed within the drive shaft housing 54. From this expansion chamber, the exhaust gases are discharged to the atmosphere through a suitable exhaust outlet. As is well known in the outboard motor practice, the suitable exhaust outlet may include an under water, high speed exhaust gas discharge and an above the water, low speed exhaust gas discharge. Because these types of systems are well known to those of ordinary skill in the art, a further description of them is not believed to be necessary to permit those of ordinary skill in the art to practice the present invention.

The illustrated outboard motor 50 also comprises a water cooling system. With reference to FIG. 1(A), the cooling system generally comprises a water pump 210, a pick-up 212 and a discharge 214. The water pump 210 preferably is driven by the rotary motion of the crankshaft 72 and, in some applications, can be driven by the drive shaft. Water is pulled from the body of water in which the watercraft is operating through a pick-up 212. The water then is delivered to the engine 58 through suitable piping and conduits. In the engine, the water can circulate through various water jackets prior to being exhausted through the discharge 214. The discharge 214 can be associated with the exhaust system or can be separate of the exhaust system.

With reference to FIG. 2, the outboard motor 50 also preferably includes a starter 165 and flywheel 167. These components of the outboard motor 50 are well known in the art; thus, a description is not necessary.

As indicated above, the ECU 108 samples a variety of data for use in performing any of a number of control strategies. With reference to FIGS. 1(A) and 1(B), the ECU 108 receives an input from an atmospheric pressure sensor 304. The atmospheric pressure sensor 304 inputs a value corresponding to the atmospheric pressure in which the watercraft is operating. In addition, the ECU 108 receives a signal from a trim angle sensor 308. As is known, the trim angle sensor 308 sends a signal to the ECU 108 that is indicative of the tilt or trim angle of the outboard motor 50 relative to the watercraft on which the outboard motor 50 is mounted.

With particular reference to FIG. 1(A), the outboard motor 50 also features a coolant temperature sensor 312. The coolant temperature sensor 312 preferable indicates the temperature of the coolant being circulated through the engine 58. The ECU 108 also receives an input from a lubricant level sensor 314. The lubricant level sensor 314 outputs a signal to the ECU 108 indicative of a fill state of the main lubricant reservoir 103.

With reference now to FIG. 1(C), the engine 58 also includes an oxygen sensor 316. The oxygen sensor 316 outputs a signal to the ECU 108 representative of the oxygen content within the exhaust gas flow. As is known to those of ordinary skill in the art, the content of oxygen within the exhaust flow can be used to determine how complete the combustion occurring within the combustion chamber 110 actually is. Moreover, the engine 58 includes a back pressure sensor 320 positioned along the exhaust system to indicate the back pressure being developed within the exhaust system of the engine 58. As will be recognized by those of ordinary skill in the art, the back pressure developed within the exhaust system can vary depending upon the depth of the underwater discharge and whether the above water discharge becomes submerged.

With reference now to FIG. 1(B), the engine also features at least one sensor to determine the engine operating speed and the specific cylinder being fired at any particular time. In the illustrated arrangement, the engine includes a crankshaft speed sensor 322 which outputs a signal to the ECU 108 indicative of a rotational speed of the crankshaft. As is known, the rotational speed of the crankshaft 322 corresponds to the engine speed. In addition, the engine 58 can include a cylinder identification sensor. The cylinder identification sensor transmits a signal to the ECU 108 that indicates which cylinder is being fired at what time during operation of the engine 58. As will be recognized by those of ordinary skill in the art, in some applications, a single sensor or multiple sensors can be used to both indicate which cylinder is operating as well as the engine speed.

The fuel supply system also includes a fuel pressure sensor 326. The fuel pressure sensor 326 preferably is positioned between the high pressure pumping apparatus 140 and the pressure regulator 188. The pressure sensor 326 provides a signal to the ECU 108 which is indicative of the pressure within the fuel supply system. The pressure of the fuel is used to calculate the amount of fuel injected through the fuel injectors 114.

The air induction system also includes a sensor 328 that outputs a signal to the ECU 108 which is indicative of an air temperature within the induction system. The induction system also can include a sensor 330 that emits a signal indicative of a throttle opening angle. This signal can also be used to determine the speed of change of the throttle angle.

While the control system generally comprises the ECU 108 and the above listed sensors which sense various operating conditions for the engine, as well as ambient conditions and/or conditions of the outboard motor that may affect general engine performance, other sensors can also be used with the present invention. While certain of the sensors have been shown schematically in FIG. 1, and were described with reference to that figure, it should be readily apparent to those of ordinary skill in the art that other types of sensing arrangements also can be provided for performing the same functions and/or different functions. Moreover, it is also practicable to provide other sensors, such as an engine knock sensor, a watercraft pitch sensor, and an engine vibration sensor in accordance with various control strategies. Of course, the signals, while being depicted with wire connections, also can be transmitted using radio waves, infrared transmitter and receiver pairs, and other suitable or similar techniques.

Figure 5A:
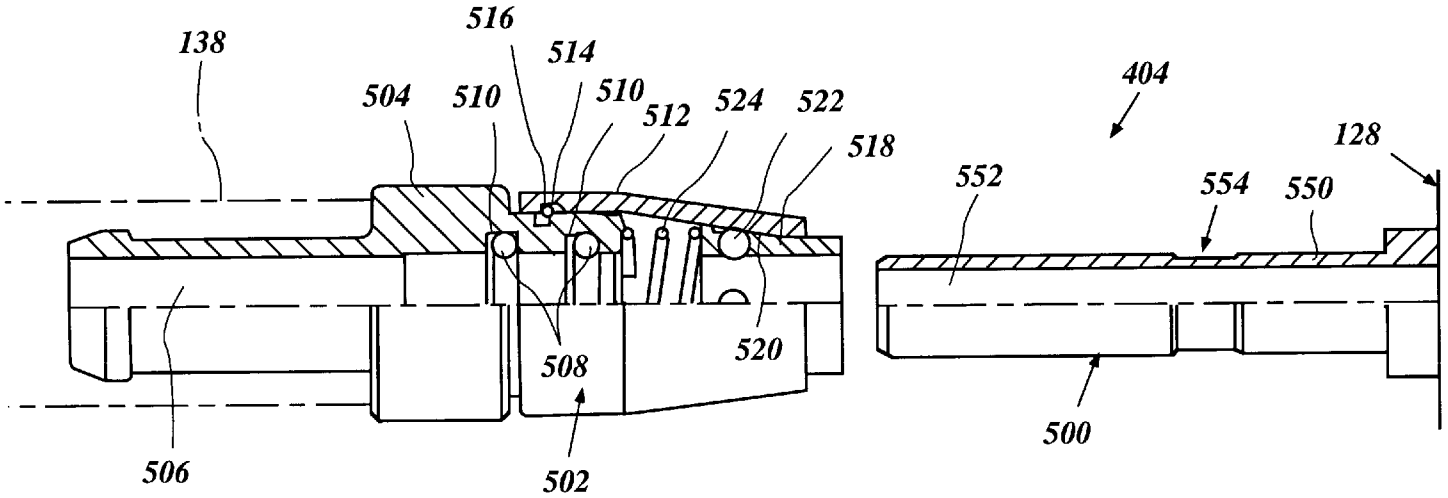
FIG. 5A is an enlarged partial cross-sectional view of the female and male portions of a connector between the fuel supply assembly and the high pressure fuel injection assembly, wherein the female and male portions are shown separated.
Figure 5B:
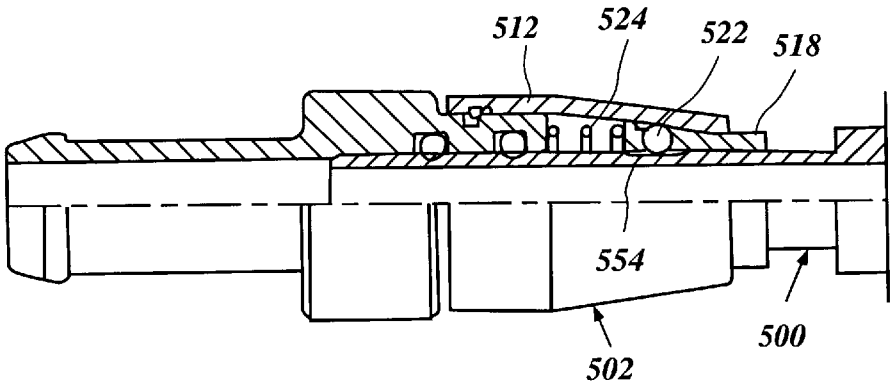
FIG. 5B is another enlarged partial cross-sectional view of the female and male portions of the connector between the fuel supply assembly and the high pressure fuel injection assembly, wherein the female and male portions are shown connected together.

With reference now to FIGS. 5A and 5B, one preferred construction of the quick connect 404 will be described in detail. The quick connect 404 is comprised of a female connector 502 that is connected to one end of the fuel supply pipe 138 and a male connector 500 that is formed at the side of the fuel filter 128. Desirably, these connection are leak-proofed or otherwise treated to reduce or eliminate the likelihood of fuel leakage. The female connector 502 is comprised of a connector body 504, which defines a fuel passage 506. A pair of O-rings 508 are embedded in an pair of grooves 510 formed on the inner periphery of the fuel passage 506. A tapered pipe 512 is inserted over the end of the connector body 504. The tapered pipe 512 includes a stopper ring 514 that engages a positioning groove 516 formed on the outer periphery of the tapered pipe 512. The positioning groove 516 is oversized relative to the stopper ring 514 to allow relative movement between the tapered pipe 514 and the connector body 504.

A stopper pipe 518 is slidably inserted into the tapered inner portion 520 of the tapered pipe 512. Four ball members 522 (only one shown) extend through a portion of the wall of the stopper pipe 518 for a purpose that will become apparent. A spring 524 is positioned between the stopper pipe 518 and the connector body 504 and urges the components apart.

The male connector 500 is comprised of a tube (or a pipe-like member) 550, which defines a fuel passage 552. The outer periphery of the illustrated tube 550 includes a stopper groove 554 and a chamfered.

Accordingly as shown in FIG. 5B, as the tube 550 is inserted into the stopper pipe 518, the ball members 522 engage the stopper groove 554. In this position, the spring 534 presses the stopper pipe 518 against the tapered portion 520. Accordingly, the tapered pipe 512 exerts an axial force on the stopper pipe 518. This creates tight seal between the stopper pipe 518 and the pipe 550 of the male connector 500. Additionally, the end of the male connector contacts a step defined with the interior of the fuel passage 506 of the female connector 502. Moreover, the two O-rings 508 are compressed and form a seal between the female connector 502 and the male connector 500.

To disengage these two members, the stopper pipe 518 is pressed against the spring 524, which disengages the stopper pipe 518 from the tapered pipe 512. The axial force on the pipe 550 is decreased and the female connector 502 can be removed from the male connector 500.

With the arrangement described above, the vapor separator assembly 116 comprises the fuel filter 128 and the vapor separator 130. The vapor separator assembly 116 is mounted on the engine 58 as shown in FIGS. 3 and 4. The removable connector 404 is used to removably couple the fuel filter 128 to fuel supply pipe 138. Accordingly, an advantage of this arrangement is that when assembling the engine, the vapor separator assembly 116 and a high pressure assembly 118 can be mounted to the engine first. The vapor separator assembly 116 and a high pressure assembly 118 can then be quickly coupled together by connecting the male 500 and female 502 parts of the connector 404 together. In a similar manner, for engine repair or maintenance, the vapor separator assembly 116 and a high pressure assembly 118 are removed preferably after the male 500 and female 502 parts of the connector 404 are separated.

In the illustrated arrangement the connector 404 is located directly adjacent to the fuel filter 128. This positioning advantageously increases the accessibility of the connector. However, it should be appreciated that the quick connector 404 can be located at any point between the vapor separator assembly and the high pressure assembly.

Figure 6:
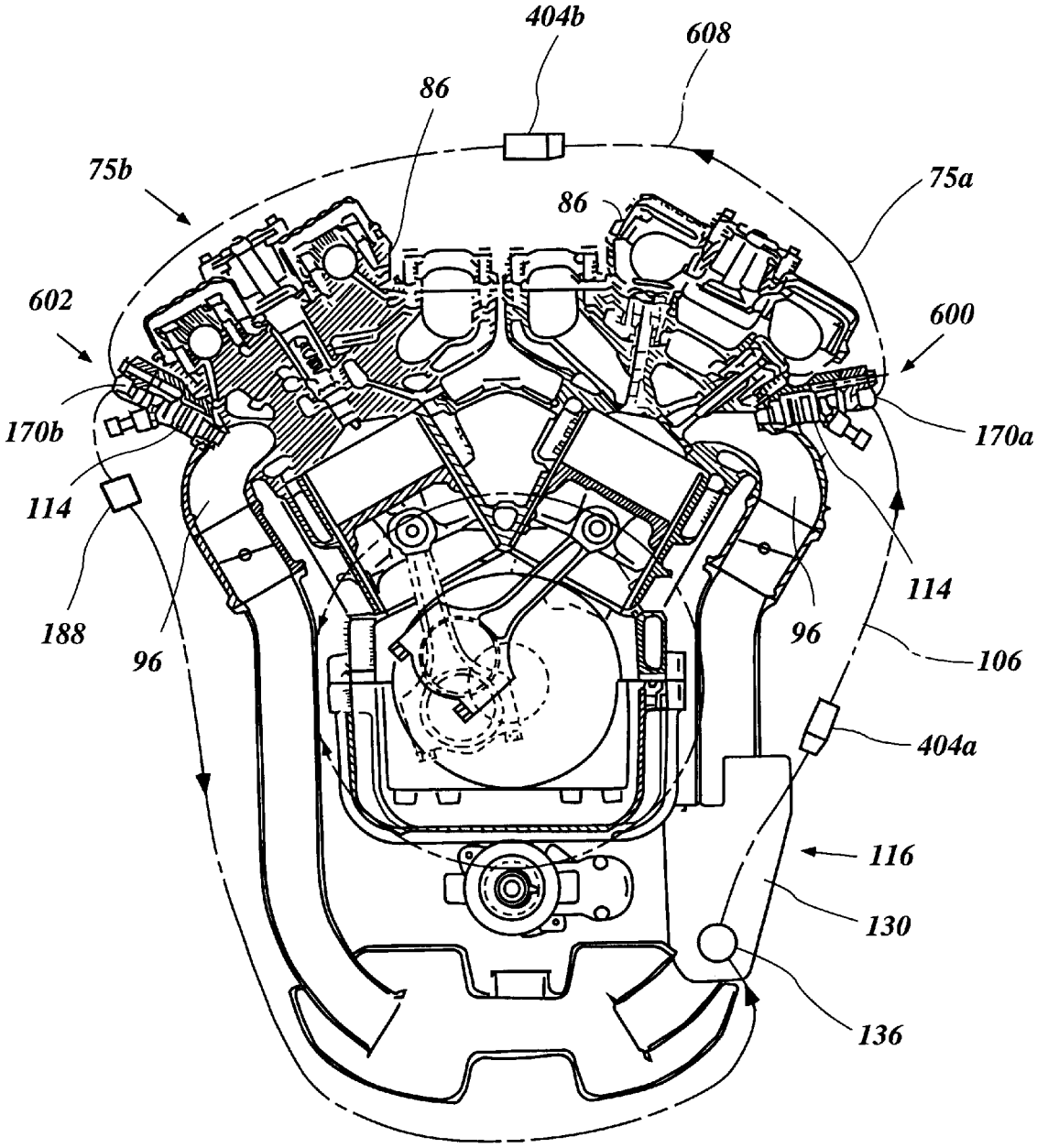
FIG. 6 is a top plan view of a modified arrangement of the power head of FIG. 1.

FIG. 6 schematically illustrates a modified arrangement the present invention. In this arrangement the quick connector 404 is applied to a four-cycle V-type engine wherein the fuel injectors 114 inject fuel into the intake passages 96. Because the fuel injectors 114 for the first and second cylinder banks 75*a,b* are substantially separated, the illustrated engine includes a first high pressure assembly 600 and a second high pressure assembly 602.

Desirably, in this arrangement, the removable connectors 404 are provided between (i) the vapor separator assembly 116 and the first high pressure assembly 600 and (ii) the first high pressure assembly 600 and the second high pressure assembly 602. Specifically, a first connector 404*a* is provided within first conduit 606, which connects the vapor separator assembly 116 to the first high pressure assembly 600. A second connector 404*b* is provided in a second conduit 608, which connects the first high pressure assembly 600 to the second high pressure assembly 602.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A fuel injected system for an internal combustion engine comprising a high pressure fuel system and a vapor separator assembly, said high pressure fuel system including a fuel injector and being removably attached to said engine, said vapor separator assembly including a vapor separator and also being removably attached to said engine, said high pressure fuel system and said vapor separator assembly being connected by a quick connector, wherein said vapor separator assembly further includes fuel filter located at a discharge end of said low pressure fuel pump, where the outlet of said fuel filter forms part of said quick connector.

2. A fuel injected system as set forth in claim 1, wherein said high pressure fuel system includes a high pressure fuel pump for supplying high pressure fuel to said fuel injector, and wherein said vapor separator assembly further includes a low pressure fuel pump.

3. A fuel injected system as set forth in claim 1, wherein said high pressure fuel system includes a first part and a second part, and wherein said first part is connected to said vapor separator assembly by a first quick connector and wherein said second part is connected to said first part by a second quick connector.

4. A method for assembling a fuel injection system for an internal combustion engine comprising:

providing a high pressure fuel system that includes a fuel injector, providing a vapor separator assembly that includes a vapor separator, a low pressure fuel pump and a fuel filter located at a discharge end of said low pressure fuel pump, attaching the high pressure fuel system to said engine;

attaching said vapor separator assembly to said engine;

forming a substantially leak proof connection between said high pressure fuel system and said vapor separator assembly by combining two ends of a quick connector, which comprises said outlet of said fuel filter.

5. A method as set forth in claim 4, wherein attaching said high pressure fuel system and said vapor separator assembly to said engine occurs before forming said substantially leak proof connection.

6. A method for disassembling a fuel injection system for an internal combustion engine comprising:

disconnecting a substantially leak proof connection between a high pressure fuel system that includes a fuel injector and a separator assembly that includes a vapor separator by separating a first end of a quick connector and a second end of the quick connector, which comprises an outlet of a fuel filter that is located at a discharge end of a low pressure fuel pump of the vapor separator;

detaching said high pressure from said engine; and detaching said vapor separator assembly from said engine.

7. A method as set forth in claim 6, wherein disconnecting said substantially leak proof connection occurs before detaching said high pressure fuel system and said vapor separator assembly from said engine.

8. A fuel injected system for an internal combustion engine comprising a high pressure fuel system and a vapor separator assembly, said high pressure fuel system including a fuel injector and a high pressure fuel pump for supplying high pressure fuel to said fuel injector, said high pressure fuel system being removably attached to said engine, said vapor separator assembly including a vapor separator and said vapor separator assembly further includes a low pressure fuel pump that includes a discharge end connected to a fuel filter, said vapor separator assembly also being removably attached to said engine, said high pressure fuel system and said vapor separator assembly being connected by a quick connector where an outlet of said fuel filter forms part of said quick connector.

9. An outboard motor comprising an engine disposed within a protective cowling, the engine comprising a fuel supply system, said fuel supply system comprising a first component, a second component and a fuel filter, said first component communicating with a first supply line, a first connection between said first component and said first supply line being substantially leak-proof, said second component communicating with a second fuel supply line, a second connection between said second component and said second fuel supply line being substantially leak-proof, said first supply line and said second fuel supply line being connected together by a quick-connect coupling and said quick connect coupling being positioned proximate to said fuel filter.

10. The motor of claim 9, wherein said first supply line and said quick-connect coupling is formed in part by an outlet of said fuel filter.

11. The motor of claim 9, wherein the first component is a low pressure subassembly and said second component is a high pressure assembly.

12. The motor of claim 11, wherein said low pressure subassembly comprises a vapor separator tank.

13. The motor of claim 11, wherein said high pressure subassembly comprises at least one fuel injector.

14. The motor of claim 9, wherein said fuel filter extends outward from said engine for ease of access and maintenance.

15. The motor of claim 9, wherein said first component is a first fuel injection system associated with a first cylinder bank and said second component is as second fuel injection system associated with a second cylinder bank.

16. The motor of claim 9, wherein said fuel supply system comprises a return line having a pressure regulator and said quick connect coupling is disposed downstream of a low pressure tank and upstream of said pressure regulator.

* * * * *